US006298276B1

(12) United States Patent
Iida

(10) Patent No.: US 6,298,276 B1
(45) Date of Patent: Oct. 2, 2001

(54) EMBROIDERY DATA PROCESSING APPARATUS

(75) Inventor: Yuji Iida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/192,404

(22) Filed: Nov. 16, 1998

(30) Foreign Application Priority Data

Feb. 25, 1998 (JP) ..... 10-062314

(51) Int. Cl.[7] ..... D05C 5/02
(52) U.S. Cl. ..... 700/138; 112/102.5
(58) Field of Search ..... 700/136, 137, 700/138; 112/102.5, 470.06, 475.19

(56) References Cited

U.S. PATENT DOCUMENTS 4,388,882 * 6/1983 Yamamoto et al. ..... 112/470.06
4,391,211 * 7/1983 Yamamoto et al. ..... 112/470.06
4,563,963 * 1/1986 Hanyu ..... 112/475.19
4,732,095 * 3/1988 Saito et al. ..... 112/470.02
4,962,715 * 10/1990 Hyodo et al. ..... 112/451
5,027,734 * 7/1991 Horie et al. ..... 112/451
5,038,691 * 8/1991 Boser ..... 112/475.01
5,267,169 * 11/1993 Yokoe et al. ..... 700/137

FOREIGN PATENT DOCUMENTS 6-142353 5/1994 (JP) .
6-285281 10/1994 (JP) .
6-296777 10/1994 (JP) .
8-71274 3/1996 (JP) .

* cited by examiner

*Primary Examiner*—William Grant
*Assistant Examiner*—Edward F. Gain, Jr.
(74) *Attorney, Agent, or Firm*—Oliff & Berridge, PLC.

(57) ABSTRACT

While reading and analyzing embroidery data for sewing, when an X-direction moving amount and a Y-direction moving amount are at most predetermined small amounts and seam stop data indicating a finish stitch-concentrated portion where embroidery operation is repeated over three stitches for a seam stop, is detected, an X-direction moving amount of a second one of finish stitch data is changed, the X-direction moving amount of a third one of the finish stitch data is changed, and finish stitch concentration of the seam stop is resolved by dispersing finish stitch positions. As a result, not only cutting of thread and swelling of a seam can be prevented but also a thread tightening operation can sufficiently be carried out by reducing moving distance of embroidery thread during thread tightening.

23 Claims, 16 Drawing Sheets

| EMBROIDERY DATA | X-DIRECTION MOVING AMOUNT | Y-DIRECTION MOVING AMOUNT | |
|---|---|---|---|
| FIRST STITCH | X1 | Y1 | EMBROIDERY SEAM DATA |
| SECOND STITCH | X2 | Y2 | |
| THIRD STITCH | X3 | Y3 | |
| ⋮ | ⋮ | ⋮ | |
| 250-TH STITCH | 0 | -0.03 | SEAM STOP DATA |
| 251-ST STITCH | -0.02 | 0.01 | |
| 252-ND STITCH | 0.02 | 0.02 | |
| ⋮ | ⋮ | ⋮ | |

(PATTERN SEWING CONTROL)

(SEAM STOP DATA DETECTION PROCESSING CONTROL)

Fig.12(A)

| EMBROIDERY DATA | X-DIRECTION MOVING AMOUNT | Y-DIRECTION MOVING AMOUNT |
|---|---|---|
| FIRST STITCH | X1 | Y1 |
| SECOND STITCH | X2 | Y2 |
| THIRD STITCH | X3 | Y3 |
| ⋮ | ⋮ | ⋮ |
| 250-TH STITCH | 0 | 0 |
| 251-ST STITCH | 0 | 0 |
| 252-ND STITCH | 0 | 0 |
| ⋮ | ⋮ | ⋮ |

EMBROIDERY SEAM DATA

SEAM STOP DATA

Fig.12(B)

| EMBROIDERY DATA | X-DIRECTION MOVING AMOUNT | Y-DIRECTION MOVING AMOUNT |
|---|---|---|
| FIRST STITCH | X1 | Y1 |
| SECOND STITCH | X2 | Y2 |
| THIRD STITCH | X3 | Y3 |
| ⋮ | ⋮ | ⋮ |
| 250-TH STITCH | 0 | 0 |
| 251-ST STITCH | 0.3 | 0 |
| 252-ND STITCH | -0.3 | 0 |
| ⋮ | ⋮ | ⋮ |

EMBROIDERY SEAM DATA

SEAM STOP DATA

Fig.13(A)

| EMBROIDERY DATA | X-DIRECTION MOVING AMOUNT | Y-DIRECTION MOVING AMOUNT | |
|---|---|---|---|
| FIRST STITCH | X1 | Y1 | EMBROIDERY SEAM DATA |
| SECOND STITCH | X2 | Y2 | |
| THIRD STITCH | X3 | Y3 | |
| ⋮ | ⋮ | ⋮ | |
| 250-TH STITCH | 0 | -0.03 | SEAM STOP DATA |
| 251-ST STITCH | -0.02 | 0.01 | |
| 252-ND STITCH | 0.02 | 0.02 | |
| ⋮ | ⋮ | ⋮ | |

Fig.13(B)

| EMBROIDERY DATA | X-DIRECTION MOVING AMOUNT | Y-DIRECTION MOVING AMOUNT | |
|---|---|---|---|
| FIRST STITCH | X1 | Y1 | EMBROIDERY SEAM DATA |
| SECOND STITCH | X2 | Y2 | |
| THIRD STITCH | X3 | Y3 | |
| ⋮ | ⋮ | ⋮ | |
| 250-TH STITCH | 0 | -0.03 | SEAM STOP DATA |
| 251-ST STITCH | 0.3 | 0.01 | |
| 252-ND STITCH | -0.3 | 0.02 | |
| ⋮ | ⋮ | ⋮ | |

EMBROIDERY DATA PROCESSING APPARATUS

BACKGROUND OF THE INVENTION

The invention relates to an embroidery data processing apparatus, particularly to a technology in which swelling of seams and cutting of thread are prevented by resolving concentration of stitch positions at a stitch position concentrated portion of a seam stop or the like of an embroidery pattern.

DESCRIPTION OF RELATED ART

Conventionally, according to an electronic control type embroidery machine for household use, an embroidery data memory installed to a ROM (nonvolatile memory) in a control device, is stored with practically-used patterns of linear seam, zigzag seam and the like, letter patterns of hiragana and katakana, and pattern data of a plurality of embroidery patterns of symbols, marks and various patterns. Therefore, patterns are displayed on a display, a desired pattern is searched while switching a display screen and a desired embroidery pattern is selected and, in the meantime, cloth for fabrication is mounted on an embroidery frame, a machine motor is driven by operating only an embroidery start switch and the selected pattern can be simply sewn by moving the embroidery frame respectively in an X-direction and a Y-direction.

Meanwhile, a finish point of embroidery data of the embroidery pattern is provided with seam stop data including stitch position data of several stitches in which an X-direction feed amount and a Y-direction feed amount are respectively set to very small amounts (for example, in a range of 0 to 0.05 mm) for concentrating stitch positions. Thereby, even after a thread is cut in finishing sewing the embroidery pattern, embroidery thread is prevented from coming loose owing to the seam stop. That is, the seam stop is carried out by forming densely-aggregated seams by concentrating several stitch positions substantially at one location. Further, depending on an embroidery pattern, even at a middle portion of embroidery data, an X-direction feed amount or a Y-direction feed amount may be very small and a portion of densely-aggregated embroidery seam may be included.

As mentioned above, when embroidery sewing is carried out based on seam stop data for producing a seam stop provided at a finish point of an embroidery pattern or data of a seam provided at a middle portion of embroidery data where stitch positions are densely aggregated, several stitch positions are concentrated substantially at the same location. As a result, there exist problems in which the seam is swollen in a so-called "dumpling shape." The seam looks poor in appearance, embroidery thread of an already-formed seam is susceptible to being cut due to damage by the needle by later stitching, and thread loops remain on the lower side of the cloth since a thread tightening operation cannot be carried out sufficiently. This is caused because moving resistance received from the cloth in the thread tightening operation of an upper thread loop formed by a thread ring catching shuttle by a needle thread take-up is increased owing to concentration of seams.

Here, for reference, there has been proposed an embroidery data editing apparatus in Japanese Laid-Open Patent Publication No. 8-71274 in which cutting of embroidery thread is prevented by searching respective stitch position data of embroidery data and editing the embroidery data such that seams each having a very small amount of movement where both of an X-direction feed amount and a Y-direction feed amount are 0.3 mm or less, are omitted.

SUMMARY OF THE INVENTION

It is an object of the invention to prevent cutting of thread or swelling of a seam and sufficiently carry out thread tightening operation by resolving stitch position concentration at a stitch position concentrated portion included in embroidery data.

According to an aspect of the present invention, there is provided an embroidery data processing apparatus for receiving and processing embroidery data, which is an aggregation of stitch position data for moving a cloth to be sewn independently in two orthogonal directions for embroidery sewing. The embroidery data processing apparatus includes a stitch position concentration detector that detects, by analyzing the embroidery data, a stitch position concentrated portion where sewing operation in which moving amounts of the cloth become predetermined small amounts or less is repeated, and an embroidery data change processor that performs change processing on the sewing operation based on stitch position data at the stitch position concentrated portion detected by the stitch position concentration detector to resolve concentration of stitch positions.

The stitch position concentration detector analyzes embroidery data for sewing and detects a stitch position concentrated portion where sewing operations involving moving amounts of a cloth that are a predetermined small amount or less is repeated. Accordingly, the embroidery data change processor changes the sewing operation based on the stitch position data at the stitch position concentrated portion detected by the stitch position concentration detector such that a moving amount of the cloth is increased in order to resolve the stitch position concentration.

That is, the stitch positions are dispersed by which the stitch position concentration at the stitch position concentrated portion is resolved. Accordingly, not only cutting of thread or swelling of the seam can be prevented but also the tightening operation can sufficiently be carried out by reducing moving resistance of embroidery thread in tightening the thread and a beautiful seam can be formed.

According to another aspect of the present invention, there is provided an embroidery data processing apparatus wherein the stitch position concentration detector detects a portion where the sewing operation in which the moving amounts of the cloth become the predetermined small amounts or less is continued a predetermined number of times as the stitch position concentrated portion.

According to the present invention, the stitch position concentration detector detects the portion where the sewing operation in which the moving amounts of the cloth that are a predetermined small amount or less is continued a predetermined number of times as the stitch position concentrated portion. Accordingly, concentration of the stitch positions which continue the predetermined number of times with the moving amounts of the predetermined small amounts can firmly be resolved.

Further, according to another aspect of the present invention, there is provided an embroidery data processing apparatus wherein the embroidery data change processor processes a change in the sewing operation within a range by which a sewing speed need not change when the stitch position concentrated portion is detected by the stitch position concentration detector. According to the present invention, when the stitch position concentrated portion is detected, the sewing operation is changed such that, for example, the moving amounts at an n-th stitch and thereafter of the stitch position concentrated portion is partially changed within a range whereby the sewing speed need not change or the moving amounts in at least one of two directions orthogonal to each other are changed. Therefore, the change processing of the sewing operation is simplified. Further, the sewing speed is not changed by the change processing and accordingly, the speed control can also be simplified.

Further, according to another aspect of the present invention, there is provided an embroidery data processing apparatus wherein the sewing operation is processed to change with a maximum moving amount in the range by which the sewing speed need not change. According to the present invention, the sewing operation is changed with a maximum moving amount within a range by which the sewing speed need not change and therefore, the stitch position concentration can maximally be resolved without changing the sewing speed.

Further, according to another aspect of the present invention, there is provided an embroidery data processing apparatus wherein the stitch position concentration portion includes a seam stop portion at a finish point of an embroidery pattern. In this case, the stitch position concentrated portion includes the seam stop portion at the finish point of the embroidery pattern and accordingly, the stitch position concentration at the seam stop portion of the finish point of the embroidery pattern can firmly be resolved.

Further, according to another aspect of the present invention, there is provided an embroidery data processing apparatus wherein the embroidery data change processor provides the stitch position data of a second or subsequent stitch of the stitch position concentrated portion with a maximum moving amount in a range where a sewing speed need not change. According to the present invention, the stitch position concentration can maximally be resolved without changing a first stitch position at the stitch position concentrated portion and without changing the sewing speed by changing the stitch position data of the second stitch position or later.

Further, according to another aspect of the present invention, there is provided an embroidery data processing apparatus wherein the embroidery data change processor provides the stitch position data at a second or subsequent stitch of the stitch position concentrated portion with moving amounts such that a sewing needle returns to a stitch position of a first stitch of the stitch position data.

According to the present invention, the stitch position data of the second or subsequent stitch position at the finish position concentrated portion is provided with moving amounts such that the sewing needle returns to the stitch position of the first position data. Accordingly, respective stitch positions successive to the stitch position concentrated portion are not changed.

BRIEF DESCRIPTION OF THE DRAWINGS

A preferred embodiment of the present invention will be described in detail with reference to the following figures in which like reference numerals refer to like elements, and wherein:

FIG. 12(A) is a diagram for explaining a data constitution of a plurality of stitch position data;

FIG. 12(B) is a diagram for explaining a data constitution of stitch position data in which amounts of movement at seam stop portions are changed;

FIG. 13(A) is a diagram for explaining a data constitution of a plurality of stitch position data;

FIG. 13(B) is a diagram for explaining a data constitution of stitch position data in which amounts of movement at finish stitch portions are changed.

DETAILED DESCRIPTION OF PREFERRED EMBODIMENTS

Figure 1:
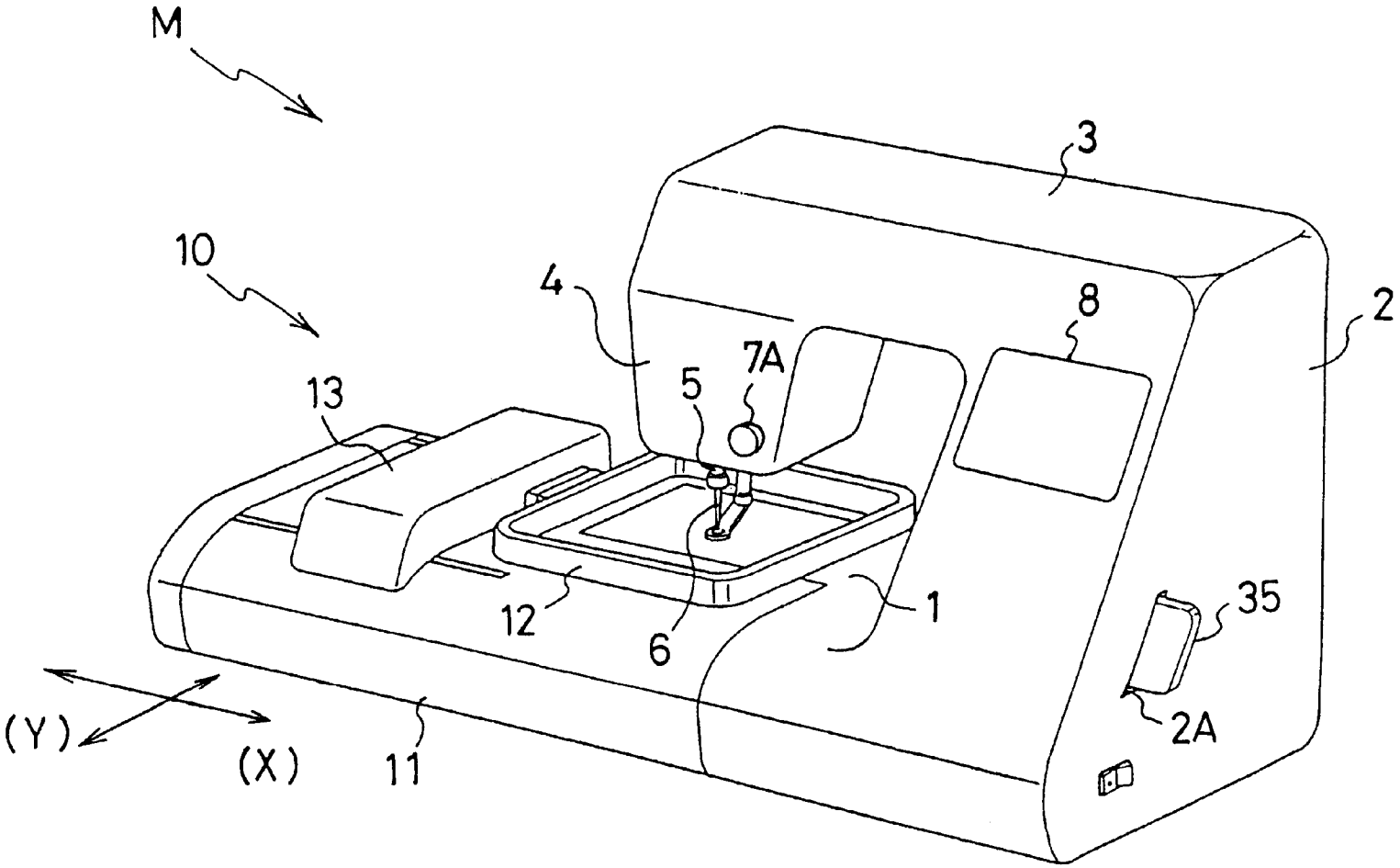
FIG. 1 is a perspective view of an electronic control type embroidery machine according to an embodiment of the present invention.

An explanation will be given of embodiments according to the present invention in reference to drawings as follows:

An embodiment is shown in FIG. 1 as an example in which the invention is applied to an electronic control type embroidery machine capable of sewing various embroidery patterns. The invention can be applied to a single embroidery machine or a gang of embroidery machines connected for coordinated control.

As shown in FIG. 1, an electronic control type embroidery machine M has a bed portion 1, a pedestal portion 2 erected from a right end portion of the bed portion 1, and an arm portion 3 extending leftward from an upper end of the pedestal portion 2 so as to be opposed to the bed portion 1.

The bed portion 1 is provided with a feed dog vertical moving mechanism (not illustrated) for moving a feed dog up and down and a feed dog horizontal moving mechanism (not illustrated) for moving the feed dog back and forth, and a thread ring catcher (for example, horizontally rotating shuttle) containing a lower thread bobbin and moving in cooperation with a sewing needle 6. The pedestal portion 2 is formed with a card slot 2*a* for connecting a ROM card 35, which stores pattern data (pattern display data, embroidery data and appended information) of a number of optionally added embroidery patterns, to an internal card connector 27 (see FIG. 2). The card slot 2A could also receive data from other sources such as, for example, a CD ROM, a stand alone processor, or some other data link.

The arm portion 3 is provided with a needle rod vertical driving mechanism (not illustrated) for moving a needle rod 5, having the sewing needle 6 at its lower end, up and down, a needle rod rocking mechanism (not illustrated) for rocking the needle rod 5 in a direction orthogonal to a cloth feed direction, and a needle thread take-up driving mechanism (not illustrated) for moving a needle thread take-up in the up and down direction in accordance with the up and down movement of the needle rod 5.

Here, the feed dog vertical moving mechanism, the needle rod vertical driving mechanism and the needle thread take-up driving mechanism are driven by a machine motor 31. The needle rod rocking mechanism is driven by a stepping motor 32 for rocking the needle rod and the feed dog horizontal moving mechanism is driven by a stepping motor 33 for driving the feed dog (see FIG. 2).

A head portion 4 of the arm portion 3 is installed with a start/stop button 7 for a start/stop switch 7*a* for instructing the starting and stopping of sewing operation.

A large liquid crystal display 8 is provided on a front face of the arm portion 3. The liquid crystal display 8 displays various seam patterns of practically-used patterns, embroidery patterns and the like, various messages and so on. The front of the liquid crystal display 8 is installed with a touch panel 9 provided with transparent electrodes in a strip-like shape respectively in the longitudinal direction and the lateral direction and functioning as touch keys in correspondence with respective display positions of a plurality of embroidery patterns and function names showing functions. That is, selection of desired embroidery patterns or instruction of function can be effectuated by pressing the touch keys 9 in correspondence with desired embroidery patterns and function names.

On the other hand, a left end side portion of the bed portion 1 is formed with a free bed portion generally referred to as a free arm. A frame driving mechanism 10 for moving an embroidery frame 12 is detachably mounted to the free bed portion.

The frame driving mechanism 10 is provided with a main body case 11, the embroidery frame 12 for detachably mounting cloth for fabrication, a containing case 13 containing a Y-direction driving mechanism for driving the embroidery frame 12 in a Y-direction (back and forth directions) and an X-direction driving mechanism contained in the main body case 11 for driving the containing case 13 and the Y-direction driving mechanism inside thereof in an X-direction (right and left directions). The X-direction driving mechanism is driven by an X drive motor 14 and the Y-direction driving mechanism is driven by a Y drive motor 15 (refer to FIG. 2).

Here, both drive motors 14, 15 are stepping motors.

When the frame driving mechanism 10 is mounted to the free bed portion, both drive motors 14, 15 are electrically connected to a control device 20 of the embroidery machine M via a connector 28. The state of mounting the frame driving mechanism 10 is detected and both drive motors 14, 15 are controlled by the control device 20 to move the embroidery frame 12 and cloth in the X-direction and the Y-direction (which correspond to two directions perpendicular to each other) independently to bring them into the state where embroidery sewing can be carried out.

Next, a control system of the embroidery machine M will be described.

Figure 2:
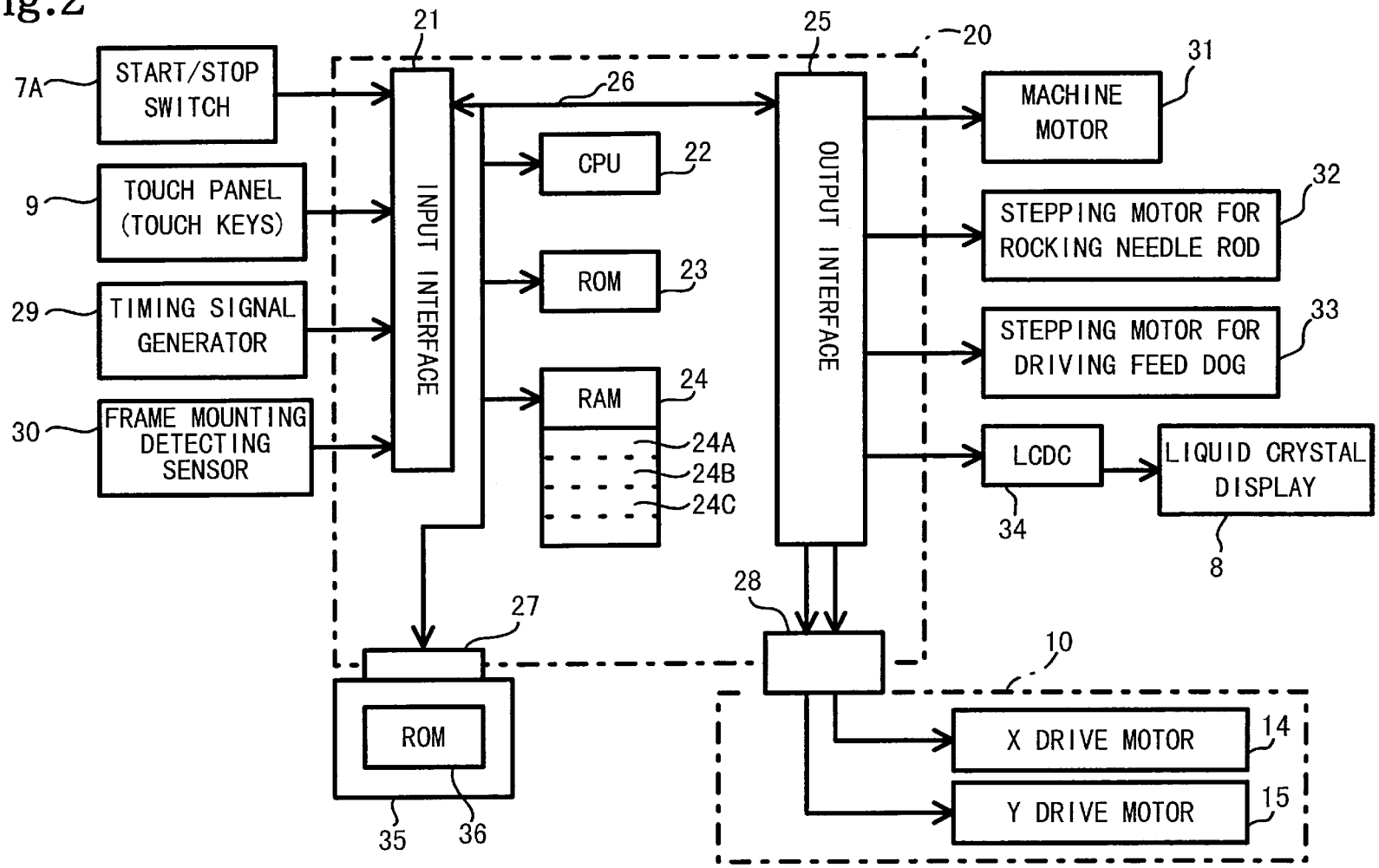
FIG. 2 is a block diagram of a control system of an electronic control type embroidery machine.
Figure 3:
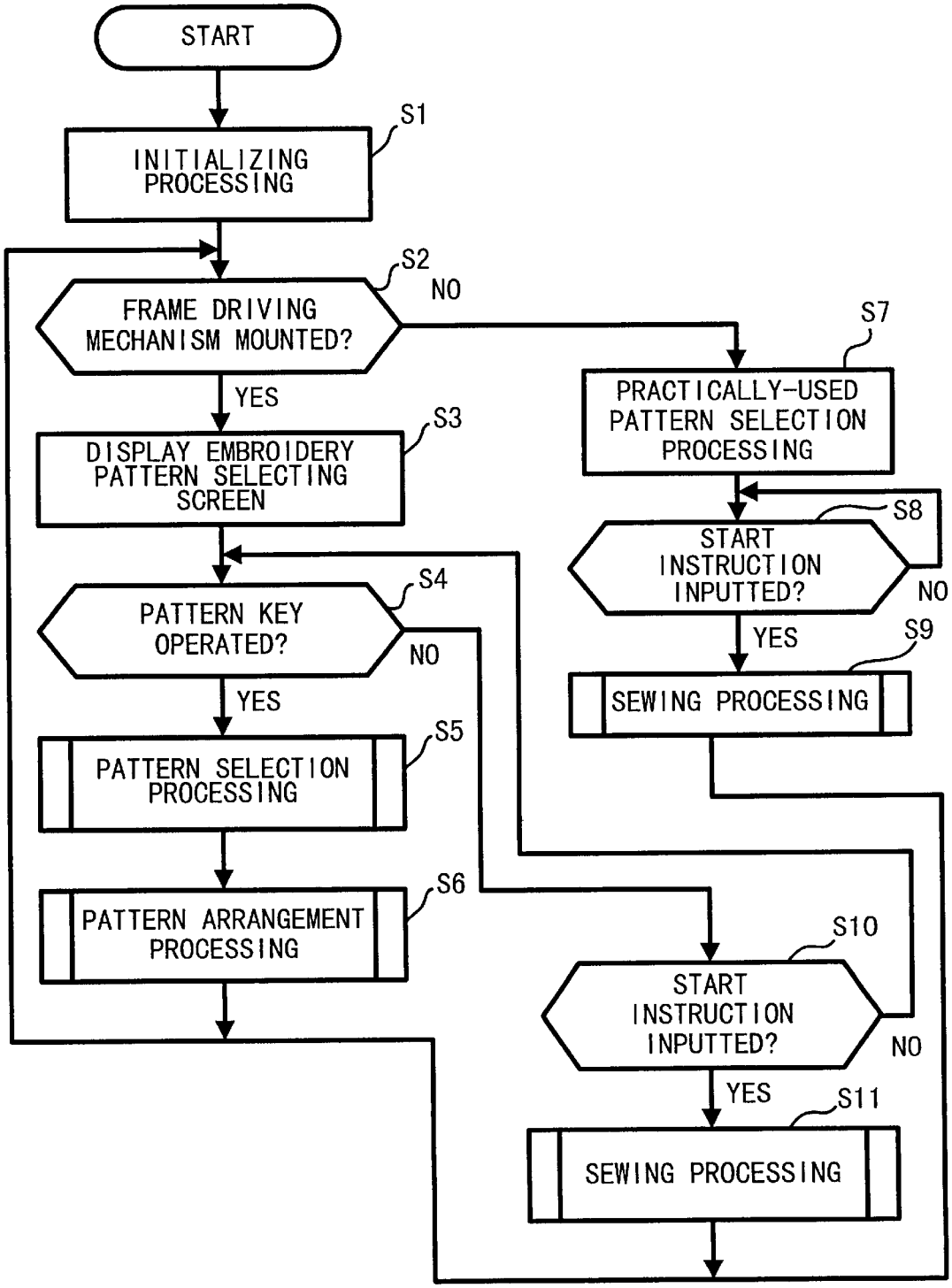
FIG. 3 is a flowchart of a routine of pattern sewing control.
Figure 4:
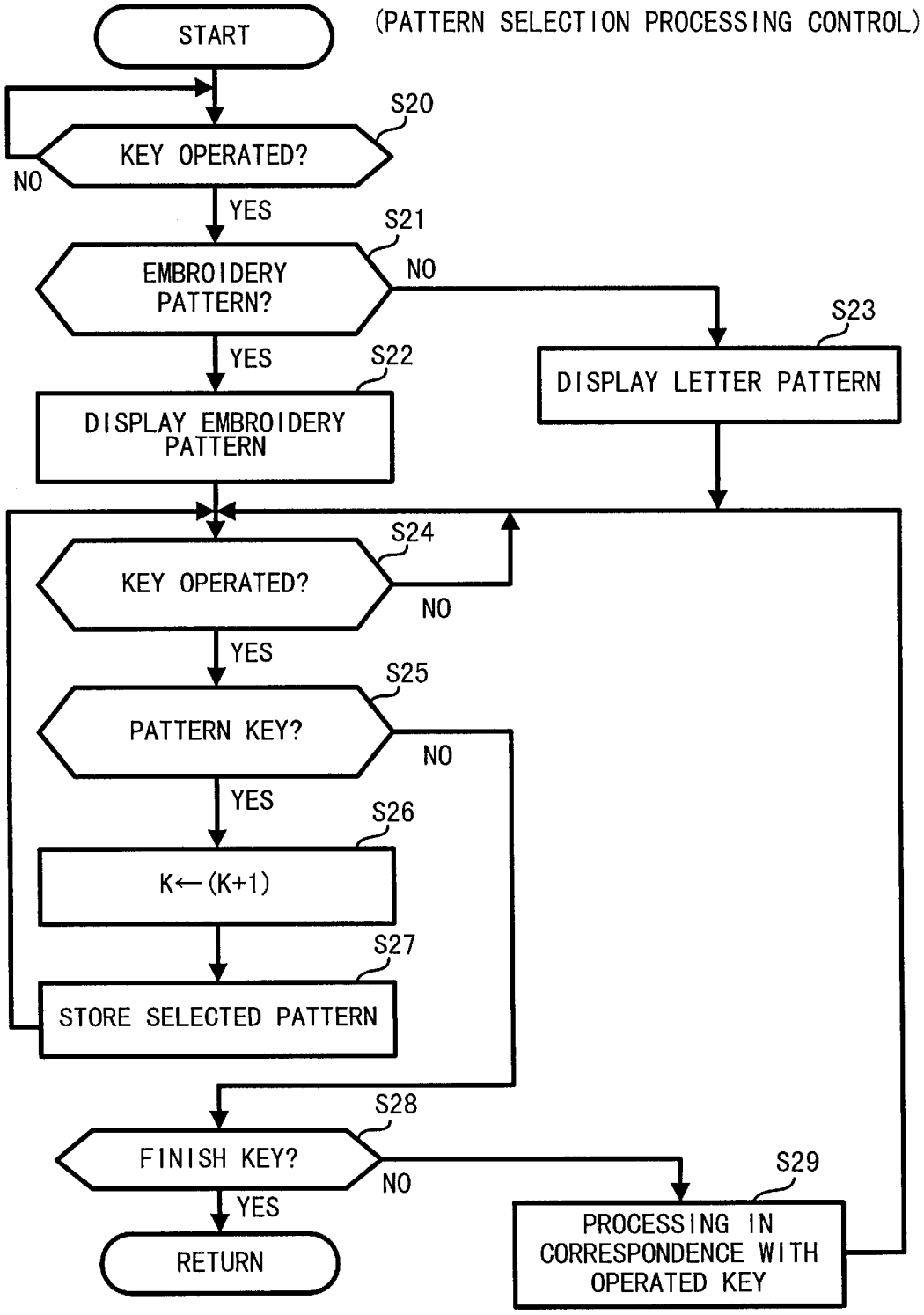
FIG. 4 is a flowchart of a routine of pattern selection processing control.

As shown in FIG. 2, the control device 20 has an input interface 21, a control unit including a CPU 22, a ROM 23 and a RAM 24, an output interface 25 and a bus 26 connecting these. The input interface 21 is respectively connected with the start/stop switch 7*a,* the touch panel (touch keys) 9, a timing signal generator 29 for detecting a plurality of rotational phases of a machine main spindle, and a frame mounting detecting sensor 30 for detecting mounting of the embroidery frame 12.

The output interface 25 is connected with the machine motor 31, the stepping motor 32 for rocking the needle bar, the stepping motor 33 for driving the feed dog, a display controller (LCDC) 34 for the liquid crystal display 8, the connector 28 connected to the X drive motor 14 and the Y drive motor 15 of the frame driving device 10 and so on. A ROM 36 of the ROM card 35 is connected to the bus 26 via a connector 27.

The ROM 23 is previously stored with a control program of pattern selecting control for selecting practically-used patterns and various embroidery patterns, general control programs of drive control for driving the respective motors 31 through 33 and 14 and 15 for sewing a selected embroidery pattern and display control. The ROM 23 is also prestored with a control program for carrying out editing processing of setting a size, changing a sewing position or the like in respect of a selected embroidery pattern via the display 8, and a control program of pattern sewing control which will be described later as the feature of the application. Further, the ROM 23 is stored with pattern data having display data and embroidery data of a plurality of practically-used patterns and practically-used letter patterns and various embroidery patterns classified in groups in accordance with kinds of patterns and attached with pattern numbers.

Meanwhile, respective embroidery data is provided with a seam stop portion at its finish point. That is, as shownin FIG. 12, moving amounts for moving in the X-direction and moving amounts for moving in the Y-direction are made to correspond to respective stitch position data (embroidery seam data) of a first stitch, a second stitch, a third stitch . . . forming an embroidery seam for moving the embroidery frame 12 in the X-direction and the Y-direction. Further, seam stop data in which the moving amounts in the X-direction and the Y-direction are set respectively to "0" are stored at three stitches (a 250-th stitch through a 252-nd stitch) in correspondence with the seam stop portion at the finish point.

Meanwhile, a plurality of the ROM cards 35 are prepared in accordance with kinds of embroidery patterns. The ROM 36 of the ROM cards 35 are stored with pattern data of a number of embroidery patterns (a first embroidery pattern, a second embroidery pattern, a third embroidery pattern . . . ) for each of various pattern groups. The pattern groups contain special various diagrams or configurations, marks, characters (for example, famous persons or characters, animals, robots and so on appeared in TV programs, movies or the like) in addition to general pattern groups of "animal", "vehicle", "flower" and so on having comparatively high frequencies of use by being classified in groups in accordance with kinds of patterns and attached with pattern numbers.

In this case, although not illustrated, when embroidery patterns are constituted by a plurality of colors (white, red, black, . . . ), pattern display data is provided with display data of color-classified pattern units in accordance with the number of colors and embroidery data is provided with sewing data for the respective color-classified pattern units and stop codes for switching color. In this case, the pattern display data is stored as bit map data (dot image data).

The RAM 24 is provided with a pattern memory 24*a* for storing pattern codes for selectively set patterns, a pattern number memory 24*b* for storing a pattern number K of a selected embroidery pattern, a flag memory 24*c* for storing flag data of a nonrotation flag F, a seam stop data change flag TF and so on and memories (memories of a pointer, a counter etc., a register, a buffer and the like) necessary for various controls described above.

Next, a routine of pattern sewing control executed by the control device 20 will be described with reference to flowcharts of FIGS. 3 to 7. Further, in these drawings, notations Si (i=1, 2, 3 . . . ) designate respective steps.

When the control is started by turning a power source on, first, initializing processing of clearing the respective memories of the RAM 24 and the pattern number count value K mentioned later and initializing the frame driving mechanism 10 is carried out (S1). When the frame driving mechanism 10 is not mounted (S2: No), practically-used pattern selection processing for selecting a practically-used pattern of a zigzag line, a straight line or the like other than embroidery patterns is executed (S7).

Further, when a start instruction is inputfrom the start/stop switch 7*a* (S8: Yes) by operating the start/stop button 7, the selected practically-used pattern is subjected to sewing processing (S9).

Figure 5:
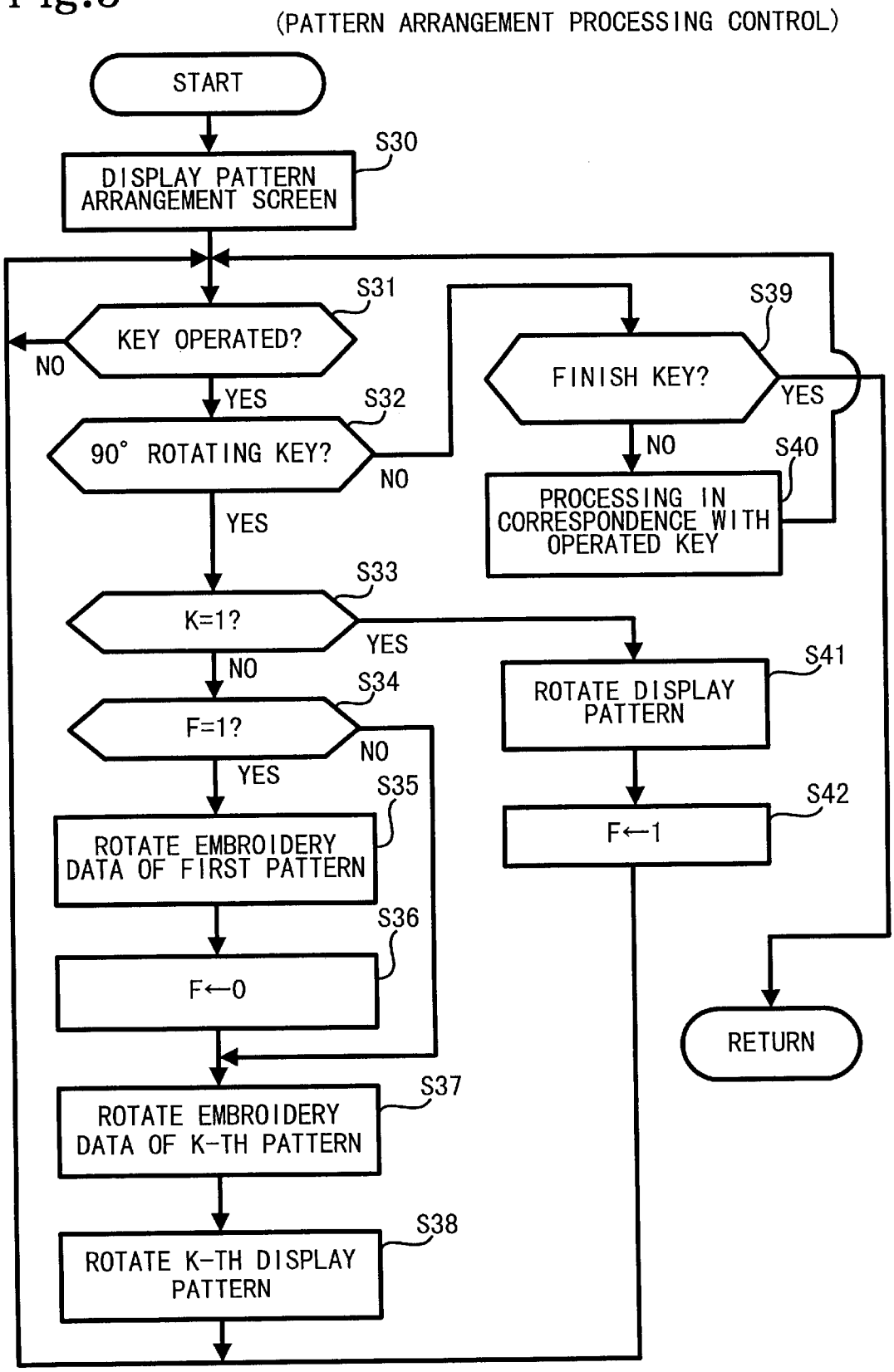
FIG. 5 is a flowchart of a routine of pattern arrangement processing control.
Figure 6:
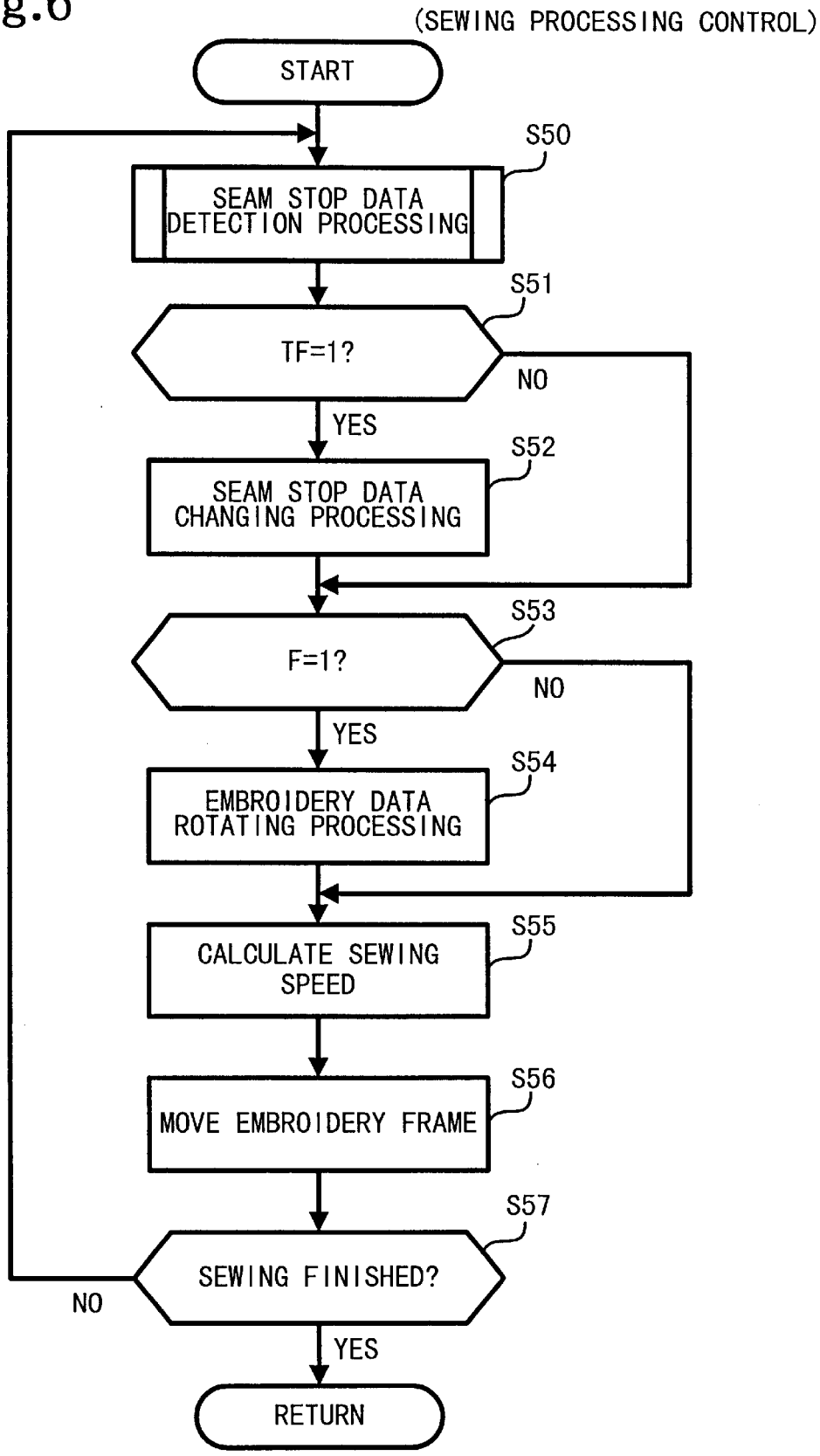
FIG. 6 is a flowchart of a routine of sewing processing control.
Figure 7:
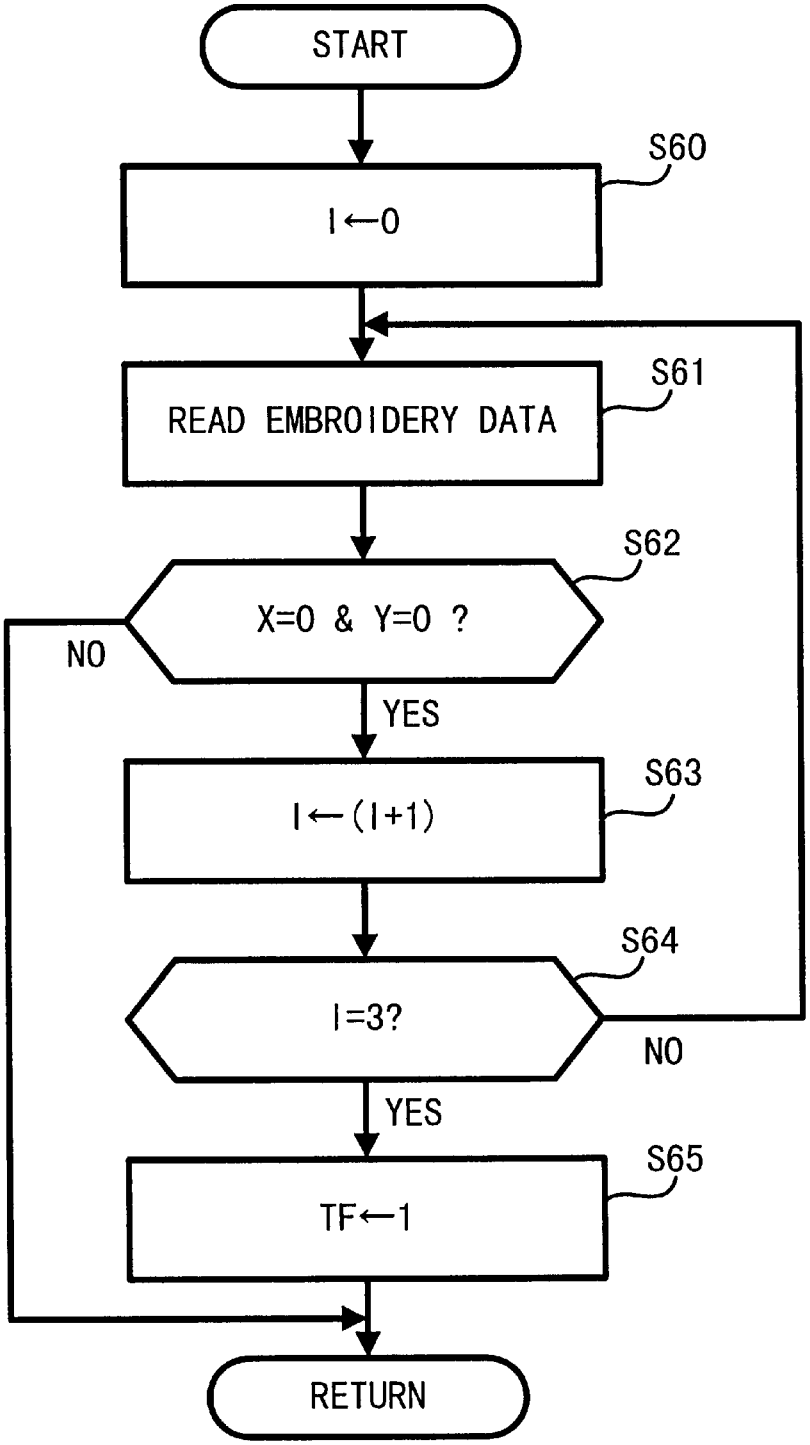
FIG. 7 is a flowchart of a routine of seam stop data detection processing control.
Figure 8:
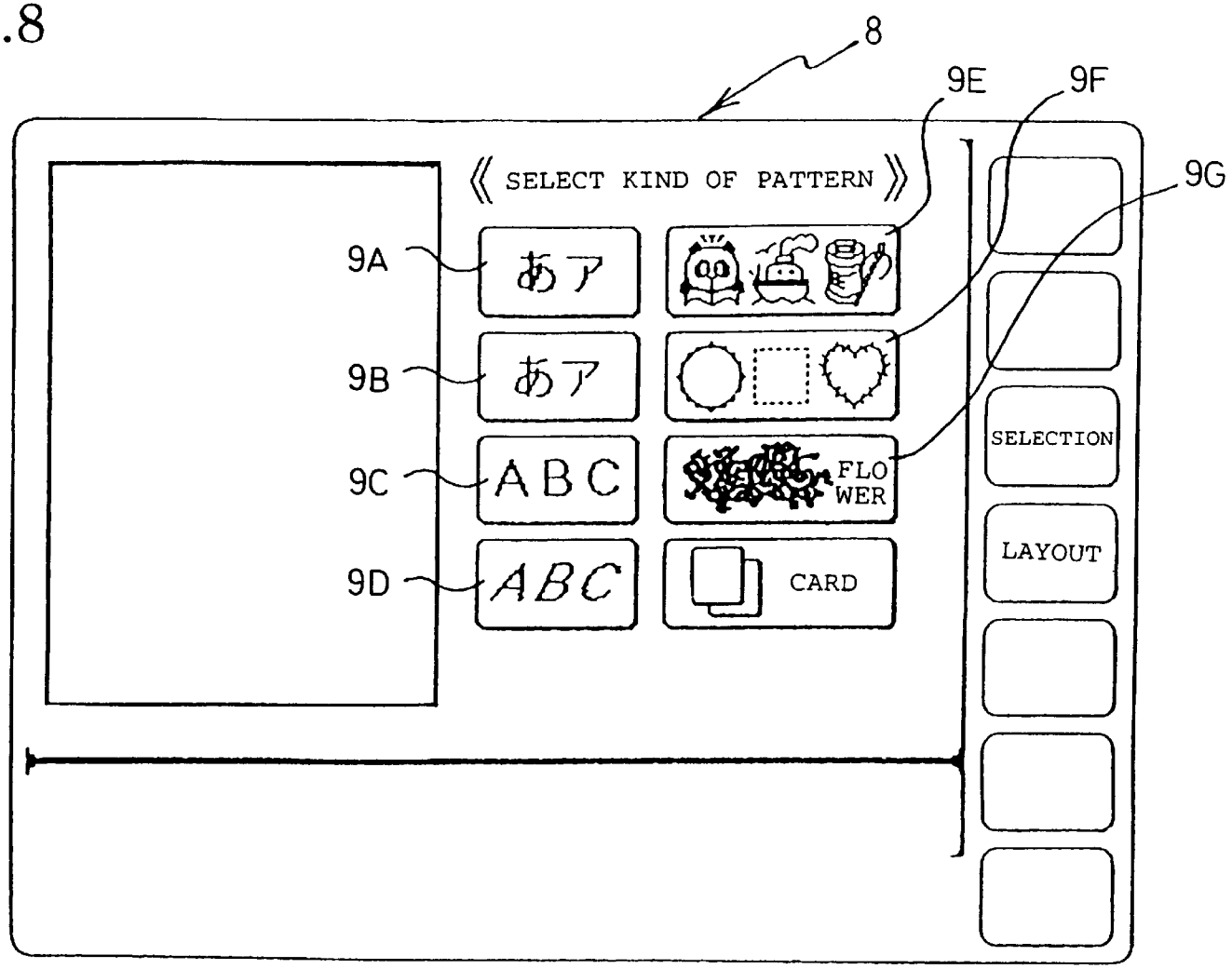
FIG. 8 is a view showing a display example of a pattern selecting screen.

On the other hand, when the frame driving mechanism 10 is mounted (S2: Yes), an embroidery pattern selecting screen for selecting various embroidery patterns other than practically-used patterns is displayed (S3). For example, as shown in FIG. 8, a selecting screen for selecting the data patterns or various embroidery patterns is displayed on the display 8. Then, when any of data pattern keys 9*a* to 9*d* and embroidery pattern keys 9*e* to 9*g* is operated (S4: Yes), pattern selection processing (refer to FIG. 4) is executed (S5) and successively, pattern arrangement processing (refer to FIG. 5 is executed.

First, when the pattern selection processing control is started and any of the embroidery pattern keys 9*e* to 9*g* is operated (S20·S21: Yes), a plurality of embroidery patterns included in the selected pattern group are displayed in a table (S22).

Figure 9:
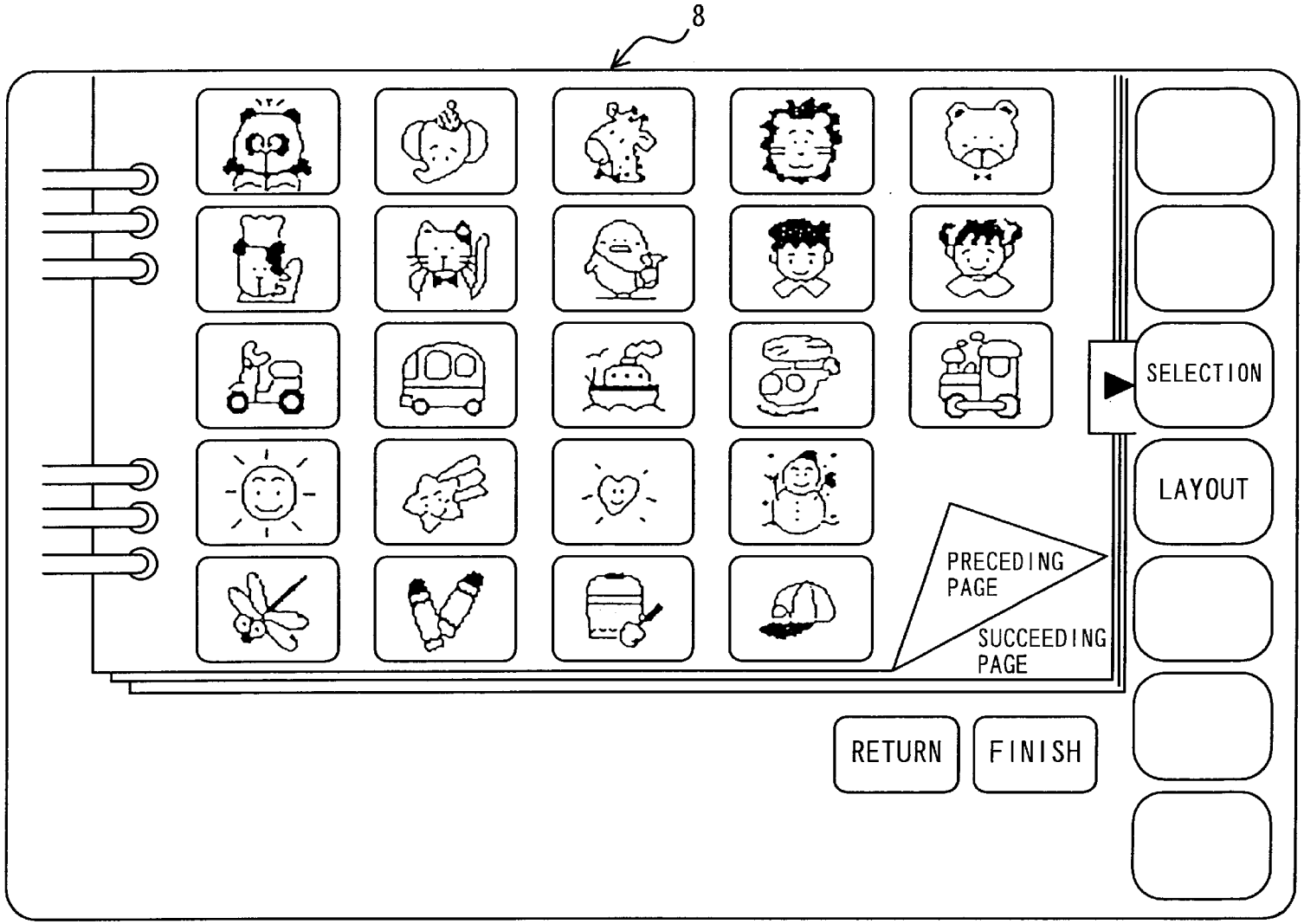
FIG. 9 is a view showing a display example of a plurality of embroidery patterns.

For example, as shown in FIG. 9, when the embroidery pattern key 9*e* is operated, a plurality of embroidery patterns concerning the "animal" or "vehicle" are displayed in a matrix. Further, when a desired pattern key is operated (S24·S25: Yes), the pattern number count value K is incremented by one (S26) and a pattern code of the selected embroidery pattern is stored to the pattern memory 24*a* (S27). When a key other than a pattern key or a finish key is operated (S24: Yes, S25·S28: No), processing in correspondence with the operated key is executed (S29). When the finish key is operated (S24: Yes, S25: No, S28: Yes), the control is finished and the operation returns to the pattern sewing control.

Figure 10:
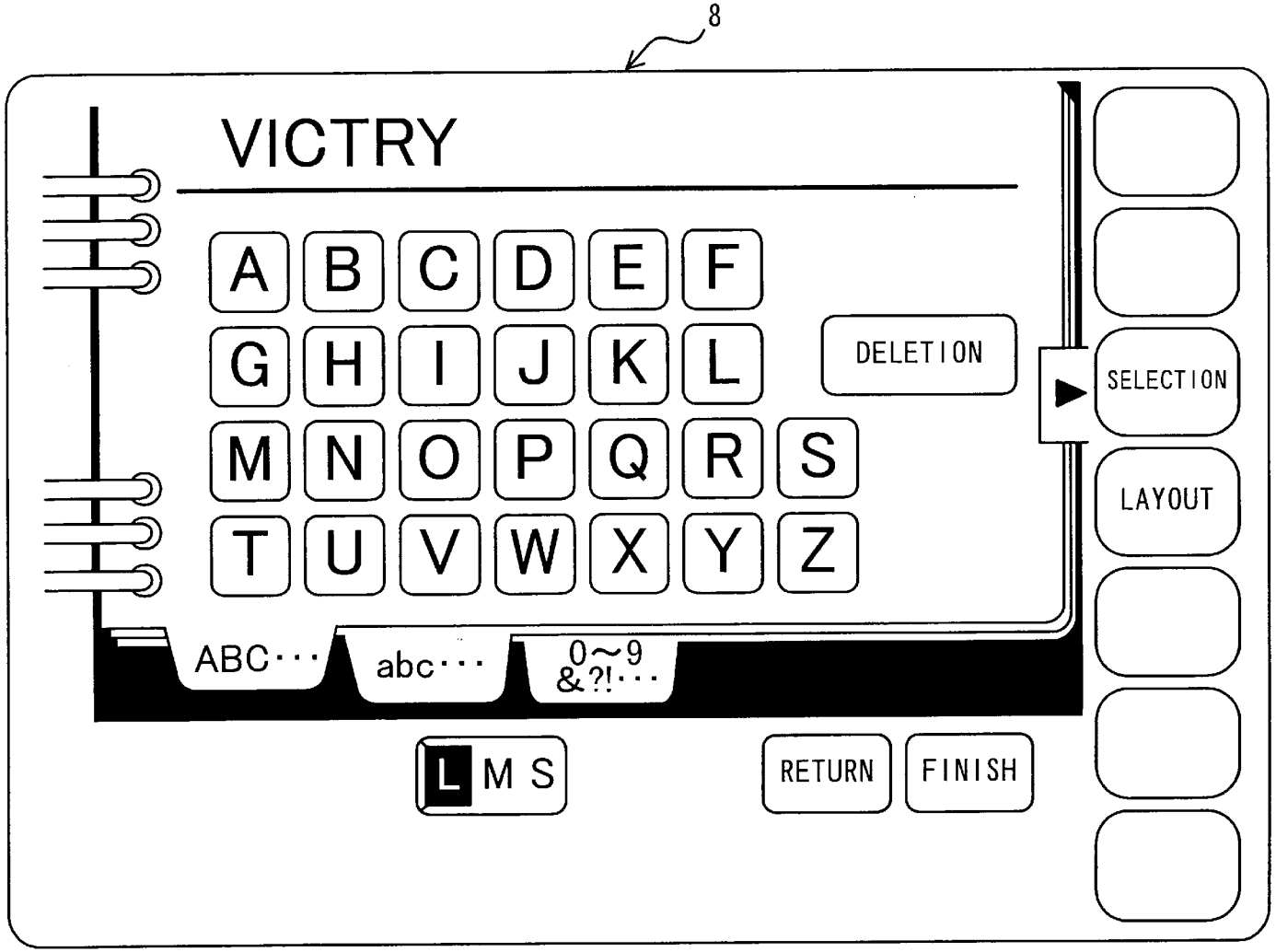
FIG. 10 is a view showing a display example of a plurality of letter patterns.

On the other hand, when any of the letter pattern keys 9*a* to 9*d* is operated (S21: No), a plurality of the letter patterns included in the selected pattern group is displayed in a table (S23). For example, as shown in FIG. 10, when the letter pattern key 9*c* is operated, "alphabet letters" are displayed in a matrix. Further, as mentioned above, a letter pattern for sewing is selected by steps S24 to S29.

Then, the pattern arrangement processing (refer to FIG. 5) is executed (S6).

Figure 11:
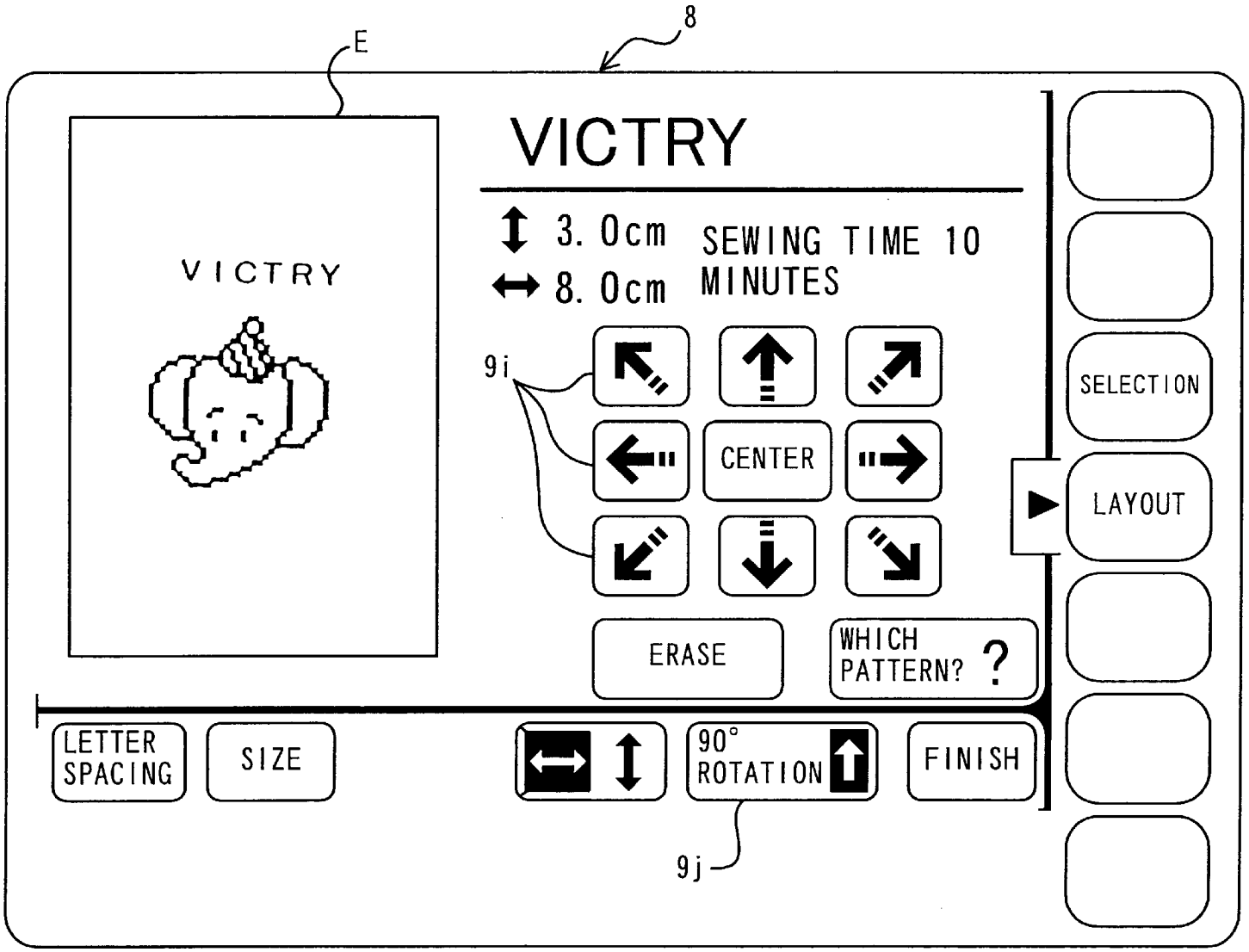
FIG. 11 is a view showing a display example of a pattern arrangement screen.

When the control is started, first, a pattern arrangement screen is displayed (S30). For example, as shown in FIG. 11, a selected embroidery pattern "elephant" is displayed at an embroidery region E of the embroidery frame 12 and various function keys including moving keys 9*i* having eight arrows and the like are displayed for moving the embroidery pattern. Further, when the moving keys 9*i* are operated (S31: Yes, S32·S39: No), as processing in correspondence with the operated key, for example, the selected embroidery pattern "elephant" is moved in a designated direction (S40).

When a 90° rotating key for rotating the embroidery pattern by 90° is operated (S31·S32: Yes), in the case where the pattern number count value K is "1" and one embroidery pattern is selected (S33: Yes), the embroidery pattern displayed in the embroidery region E is rotated by 90° (S41) and a nonrotation flag F is set since embroidery data of the embroidery pattern is not rotated (S42).

Meanwhile, when the pattern number count value K is "2" or more and embroidery patterns of K which is 2 or more, are selected (S33: No), in the case where the nonrotation flag F is set (S34: Yes), embroidery data of a first one of the embroidery patterns is rotated by 90° (S37) and embroidery data of K-th embroidery pattern is rotated by 90° (S38).

Further, when the nonrotation flag F is not set (S34: No), steps S35 and S36 are skipped and the steps S37 and S38 are executed. When the finish key is operated (S31: Yes, S32: No, S39: Yes), the control is finished and the operation returns to the pattern sewing control.

When start instruction is inputin the pattern sewing control by operating the start/stop button 7 (S10: Yes), the sewing processing (refer to FIG. 6) for sewing the selected embroidery pattern is executed (S11).

When the control is started, first, detection processing (see FIG. 7) for detecting seam stop data is executed (S50). In this case, the seam stop data search processing is executed each time the sewing needle 6 is moved from a needle plate (not illustrated) of the bed portion 1 to the lower side. Processing of moving the embroidery frame at step S56 is executed each time the sewing needle 6 rises from the needle plate.

When the control is started, an initial value "0" is first set to a count value I of a seam stop counter for counting stitch position data for seam stop (S60) and first embroidery data is read (S61).

Next, on the basis of stitch position data of the read embroidery data (the X-direction moving amount and the Y-direction moving amount), when the X-direction moving amount is "0" and the Y-direction moving amount is not "0" (S62: No), the control is immediately finished. However, when the moving amounts are "0" (S62: Yes), the seam stop count value I is incremented by one (S63). When the count value I does not reach "3" (S64: No), steps S61 to S64 are repeatedly executed. When the count value I becomes "3" (S64: Yes), the three stitches of the stitch positions correspond to a stitch position concentrated portion and therefore, a seam stop data change flag TF is set (S65), the control is finished and the operation returns to the sewing processing control.

For example, as shown in FIG. 12(*a*), when stitch position data of three stitches of a 250-th stitch through a 252-nd stitch is read in the embroidery data of the selected embroidery pattern, there is provided seam stop data where the X-direction moving amount and the Y-direction moving amount are respectively set to "0", stitch positions are concentrated and therefore, the seam stop data change flag TF is set.

When the seam stop data change flag TF is set in the sewing processing control (S51: Yes), seam stop data change processing is executed (S52).

That is, in the seam stop data change processing, as shown in FIG. 12(*b*), the X-direction moving amount of a second one of the stitch position data in the three stitch position data of the 250-th stitch through the 252-nd stitch corresponding to the stitch position concentrated portion, is changed from "0" to "0.3 mm" and the X-direction moving amount of a third one of the stitch position data is changed from "0" to "−0.3 mm." That is, when the stitch position concentrated portion is detected, as the X-direction moving amounts which are stitch position data of a second stitch and a third stitch, the sewing operation is changed by being provided with "0.3 mm" which is the maximum moving amount in a range whereby the sewing speed of the machine motor 31 need not change. Thereby, the seam stop can be executed by maximally revolving the stitch position concentration without changing the sewing speed.

Further, moving amounts for returning to the stitch position of the first stitch position data are provided by the second stitch position data (0.3 mm) and the third stitch position data (−0.3 mm) and therefore, the stitch position concentration at the stitch position concentrated portion can firmly be resolved without changing the respective stitch positions successive to the stitch position concentrated portion.

Next, when the nonrotation flag F is set (S53: Yes), rotation processing for rotating the read embroidery data by 90° is executed (S54) and a calculation for calculating the sewing speed by the main motor 31 is carried out based on the moving amounts included in the stitch position data of the this time (S55).

Further, at the predetermined timing when the sewing needle 6 rises from the needle plate, the embroidery frame 12 is moved based on the moving amounts (S56) and when the sewing operation is not finished (S57: No), step S50 and the following steps are repeatedly executed. That is, even when the moving amounts are changed to "0.3 mm" and "−0.3 mm", the sewing speed is not changed at all and accordingly, speed control can be simplified.

Further, when the sewing processing of all of the selected embroidery patterns has been finished (S57: Yes), the control is finished and the processing returns to the pattern sewing control S2.

Figure 14:
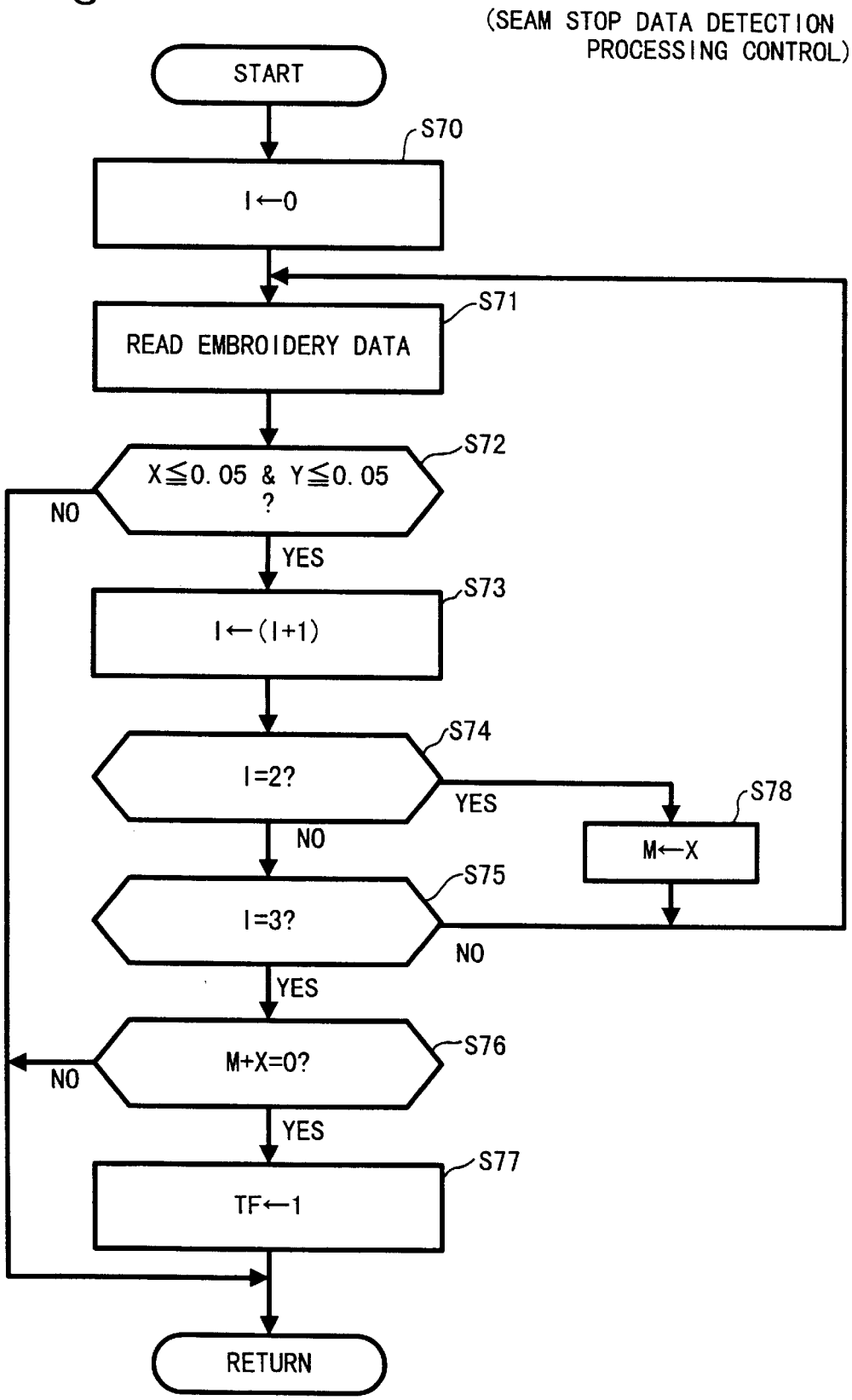
FIG. 14 is a diagram in correspondence with FIG. 7 according to a modified embodiment.

Meanwhile, as shown in FIG. 13(*a*), in the case of providing seam stop data for concentrating stitch positions such that the X-direction moving amounts and the Y-direction moving amounts are respectively set to predetermined small amounts (0 through 0.03 mm) substantially near to "0" as stitch position data of three stitches of a 250-th stitch through a 252-nd stitch in correspondence with a seam stop portion of a finish point in embroidery data of a selected embroidery pattern, the seam stop data may be detected by a seam stop data detection processing control shown in FIG. 14.

That is, an initial value "0" is set to the seam stop count value I (S70) and embroidery data is read (S71).

Next, when the X-direction moving amounts of the embroidery data are "0.05" or less and the Y-direction moving amounts are also "0.05" or less (S72: Yes), the seam stop count value I is incremented by one (S73). When the count value I is "2" (S74: Yes), the X-direction moving amount is temporarily stored as a moving amount M at a preceding time (S78). When the count value I becomes "3" (S75: Yes), in the case where a result of an addition of the moving amount X at the current time and the moving amount M at the preceding time is "0" (S76: Yes), a stitch position concentrated portion is constituted and accordingly, the seam stop data change flag TF is set (S77).

Further, when, in the sewing processing control, the seam stop data change processing is set (S51), in the seam stop data change processing at step S52, as shown in FIG. 13(*b*), similar to the above-described embodiment, in respect of the three stitch position data of the 250-th stitch through the 252-nd stitch, the X-direction moving amount of a second one of the stitch position data is changed to "0.3 mm" and the X-direction moving amount of a third one of the stitch position data is changed to "−0.3 mm". Also in this case, the amount which is to be changed to "0.3 mm" is a maximum moving amount within a range by which the sewing speed need not change in the sewing operation and the seam stop can be carried out while maximally resolving the stitch position concentration without changing the sewing speed.

In this case, an embroidery data processing device is constituted by the control device 20, the seam stop data detection processing control and the seam stop data change processing control and so on stored in the ROM 23. The stitch position concentration detector is constituted by the control device 20, the seam stop data detection processing control and so on, and the embroidery data change processor is constituted by the control device 20, the seam stop data change processing control and so on.

As described above, embroidery data for sewing is analyzed by reading it at every several stitches. The X-direction moving amount and the Y-direction moving amount are predetermined small amounts (0 through 0.03 mm) and, when seam stop data indicating a stitch position concentrated portion where sewing operation is repeated over three stitches for seam stopping is detected, the X-direction moving amount of the second stitch position data is changed to "0.3 mm", the X-direction moving amount of the third stitch position data is changed to "−0.3 mm" and the stitch positions are dispersed by which the stitch position concentration at the seam stop portion is revolved. Accordingly, not only cutting of thread or swelling of the seam can be prevented but also the tightening operation can sufficiently be carried out by reducing moving resistance of embroidery thread in tightening the thread and a beautiful seam can be formed.

Further, the amount to be changed to "0.3 mm" is a maximum moving amount in a range by which the sewing speed need not change in sewing operation and accordingly, the sewing speed is not changed. Therefore, the sewing speed control can be simplified and seam stop can be carried out while maximally resolving stitch position concentration. Further, in respect to three stitches of a seam stop portion, a stitch position at a first stitch is not changed, by a second stitch position data (0.3 mm) and a third stitch position data (−0.3 mm) being set, moving amounts for returning a sewing needle to a stitch position of the first stitch position data are provided. Accordingly, respective stitch positions of a succeeding embroidery pattern which is to be sewn successive to the seam stop portion need not change. In this case, in the seam stop data change processing, a very small moving amount may be added to the set moving amount or the set moving amount may be changed to a maximum moving amount in a range by which the sewing speed is not changed. A calculation can be performed where a coefficient larger than "1" is multiplied by the set moving amount.

Next, modifications of the aforementioned embodiment will be described.

(1) Although according to the aforementioned embodiments, the X-direction moving amount is changed with respect to the X-direction moving amount and the Y-direction moving amount of stitch position data at a stitch position concentrated portion, the Y-direction moving amount may be changed and the movements in the X-direction and the Y-direction may respectively be changed by maximum moving amounts in a range by which the sewing speed is not changed.

(2) Further, the moving amount to be changed is not limited to "0.3 mm" and may be a maximum moving amount within a range by which the sewing speed is not changed.

(3) When 5 stitches of "0.5" mm are continued as, for example, the X-direction moving amount of seam stop data, in the case where several stitches are read in advance in the sewing processing control, if moving amounts of predetermined small amounts (for example, 1 mm) or more continue for three times based on a sum (1.5 mm) of moving amounts of three stitches of a first stitch through a third stitch of the seam stop data, a sum (1.5 mm) of moving amounts of three stitches of a second stitch through a fourth stitch and a sum (1.5 mm) of moving amounts of three stitches of a third stitch through a fifth stitch, the portion may be detected as a stitch position concentrated portion by the first stitch through the fifth stitch.

(4) The pattern sewing control according to the embodiments are only examples and can be carried out by adding various modifications within a range not deviated from the technical thought of the invention.

(5) The invention is naturally applicable to various embroidery data processing devices for receiving and processing embroidery data of embroidery patterns.

While the invention has been described in conjunction with the specific embodiments described above, it is evident that many alternatives, modifications and variations will be apparent to those skilled in the art. Accordingly, the embodiments of the invention as set forth above are intended to be illustrative and not limiting. Various changes may be made without departing from the spirit and scope of the invention as defined herein.

What is claimed is:

1. An embroidery data processing apparatus for receiving and processing embroidery data which is an aggergation of snitch position data for moving a cloth constituting an object of sewing independently in two orthogonal directions for embroidery sewing, said embroidery data processing apparatus comprising:

a stitch position concentration detector that detects, by analyzing the embroidery data, a stitch position concentrated portion where sewing operation in which moving amounts of the cloth become predetermined small amounts is repeated; and an embroidery data change processor that processes a change in the sewing operation based on stitch position data at the stitch position concentrated portion detected by the stitch position concentration detector such that stitch position concentration is changed, wherein the embroidery data change processor provides the stitch position data at a second or subsequent stitch of the stitch position-concentrated portion with moving amounts such that a sewing needle returns to a stitch position of a first stitch of the stitch position data.

2. The embroidery data processing apparatus according to claim 1, wherein the stitch position concentration detector detects a portion where the sewing operation in which the moving amounts of the cloth become the predetermined small amounts is continued a predetermined number of times as the stitch position-concentrated portion.

3. The embroidery data processing apparatus according to claim 1, wherein the embroidery data change processor processes a change in the sewing operation within a range by which a sewing speed need not change when the stitch position concentrated portion is detected by the stitch position concentration detector.

4. The embroidery data processing apparatus according to claim 3, wherein the sewing operation is processed to change with a maximum moving amount in the range by which the sewing speed need not change.

5. The embroidery data processing apparatus according to claim 1, wherein the stitch position concentrated portion includes a seam stop portion at a finish point of an embroidery pattern.

6. The embroidery data processing apparatus according to claim 1, wherein the embroidery data change processor provides the stitch position data of a second or subsequent stitch of the stitch position concentrated portion with a maximum moving amount in a range where a sewing speed need not change.

7. The embroidery data processing apparatus according to claim 1, wherein the moving amount of cloth at each stitch-concentrated portion is increased without reducing a number of the stitches in order to resolve the stitch position concentration.

8. A method of embroidering stitches in embroidery data on a workpiece, the method comprising:

analyzing a stitch-concentration of the embroidery data;

detecting, based on the analysis of the stitch concentration of the embroidery data, a stitch position concentrated portion of the embroidery data in which a first distance between a first stitch and a second stitch is less than a set distance and a second distance between the second stitch and a third stitch is less than the set distance; and modifying the stitch-concentration of stitch position concentrated portion of the embroidery data such that the first distance is changed and the second distance is changed.

9. The method according to claim 8, wherein the stitch position concentrated portion is a portion of the embroidery data which has a set number of stitches each being a third distance from an immediately preceding stitch.

10. The method according to claim 8, wherein the modification of the stitch-concentration of the stitch position concentrated portion is performed without changing a sewing speed of the embroidering.

11. The method according to claim 10, wherein the first distance and the second distance are maximized.

12. The method according to claim 8, wherein the stitch position concentrated portion includes a seam stop portion at a finish point of an embroidery pattern.

13. The method according to claim 8, wherein the stitch-concentration of the second stitch position or a subsequent stitch position is modified to provide a maximum moving amount in a range where a sewing speed need not change.

14. The method according to claim 8, wherein the stitch-concentration of the stitch position concentrated portion is modified such that the second stitch position or a subsequent stitch of the stitch position concentrated portion ends at a position of the first stitch of the stitch position concentrated portion.

15. The method according to claim 8, wherein the moving amount of cloth at each stitch-concentrated portion is increased without reducing a number of the stitches in order to resolve the stitch position concentration.

16. A recording medium that stores a control program for embroidering stitches in embroidery data on a workpiece, the control program including instructions for:

analyzing a stitch-concentration of the embroidery data;

detecting, based on the analysis of the stitch concentration of the embroidery data, a stitch position concentrated portion of the embroidery data in which a first distance between a first stitch and a second stitch is less than a set distance and a second distance between the second stitch and a third stitch is less than the set distance; and modifying the stitch-concentration of the stitch position concentrated portion of the embroidery data such that the first distance and the second distance are changed.

17. The recording medium according to claim 16, wherein the stitch position concentrated portion is a portion of the embroidery data which has a set number of stitches each being a third distance from an immediately preceding stitch.

18. The recording medium according to claim 16, wherein the modification of the stitch-concentration of the stitch position concentrated portion is performed without changing a sewing speed of the embroidering.

19. The recording medium according to claim 18, wherein the first distance and the second distance are maximized.

20. The recording medium according to claim 16, wherein the stitch position concentrated portion includes a seam stop portion at a finish point of an embroidery pattern.

21. The recording medium according to claim 16, wherein the stitch-concentration of the second stitch position or a subsequent stitch position is modified to provide a maximum moving amount in a range where a sewing speed need not change.

22. The recording medium according to claim 16, wherein the stitch concentration of the stitch position concentrated portion is modified such that the second stitch or a subsequent stitch of the stitch position concentrated portion ends at a position of the first stitch of the stitch position concentrated portion.

23. The recording medium according to claim 16, wherein the moving amount of cloth at each stitch-concentrated portion is increased without reducing a number of the stitches in order to resolve the stitch position concentration.

* * * * *